United States Patent [19]

Barlow et al.

[11] Patent Number: 4,470,334

[45] Date of Patent: Sep. 11, 1984

[54] MUSICAL INSTRUMENT

[75] Inventors: Gordon A. Barlow, Glenview; Richard A. Karlin, Chicago, both of Ill.

[73] Assignee: Gordon Barlow Design, Skokie, Ill.

[21] Appl. No.: 427,824

[22] Filed: Sep. 29, 1982

[51] Int. Cl.[3] ..... G10H 3/02

[52] U.S. Cl. ..... 84/1.28; 84/480; 84/483 R

[58] Field of Search ..... 84/1.01, 1.03, 1.28, 84/462, 480, 483 R, 483 A, 485 R, 485 SR

[56] References Cited

U.S. PATENT DOCUMENTS

| | | | |
|---|---|---|---|
| 3,710,671 | 1/1973 | Reid, Sr. et al. | 84/483 R |
| 4,242,936 | 1/1981 | Swain | 84/1.03 |
| 4,250,787 | 2/1981 | Segan et al. | 84/1.01 |
| 4,269,101 | 5/1981 | Deutsch et al. | 84/1.01 |
| 4,294,155 | 10/1981 | Turner | 84/1.01 |

*Primary Examiner*—Stanley J. Witkowski
*Attorney, Agent, or Firm*—Kinzer, Plyer, Dorn & McEachran

[57] ABSTRACT

A musical instrument having a housing. A well is formed in one surface of the housing and adapted to receive a card. A slide is mounted on the housing for movement across the surface of the card. The card containing printed indicia, each of which represents a note of a musical composition with the indicia arranged in a generally rectangular matrix. The indicia on the card are arranged in one direction across the matrix to indicate the sequence of notes played in a musical composition from the beginning to the end thereof. The indicia are arranged in the direction across the matrix extending at right angles to the sequence of playing to indicate changes in frequency of the notes from the lowest frequency on one side of the matrix to the highest frequency on the other side. The slide extends across the card and the well in the direction of the sequence of playing the notes of the composition. The slide is mounted to permit its movement across the face of the card in the direction of change of frequency and the slide can be stopped at any selected position in this direction. An electrical contact is carried by the slide. A plurality of stationary electrical contacts are positioned in the path of movement of the slide contact. The card is indexed so that all of the indicia representing a note of particular frequency aligned with a particular stationary electrical contact so that positioning of the slide over the printed indicia of notes of the same frequency on the card will position the slide contact and a particular stationary frequency contact in electrical engagement. An electronic apparatus is connected to each stationary frequency contact to sound a musical note of a selected frequency when the slide is positioned over the printed indicia on the card representing the notes of that frequency.

1 Claim, 7 Drawing Figures

Fig. 1.
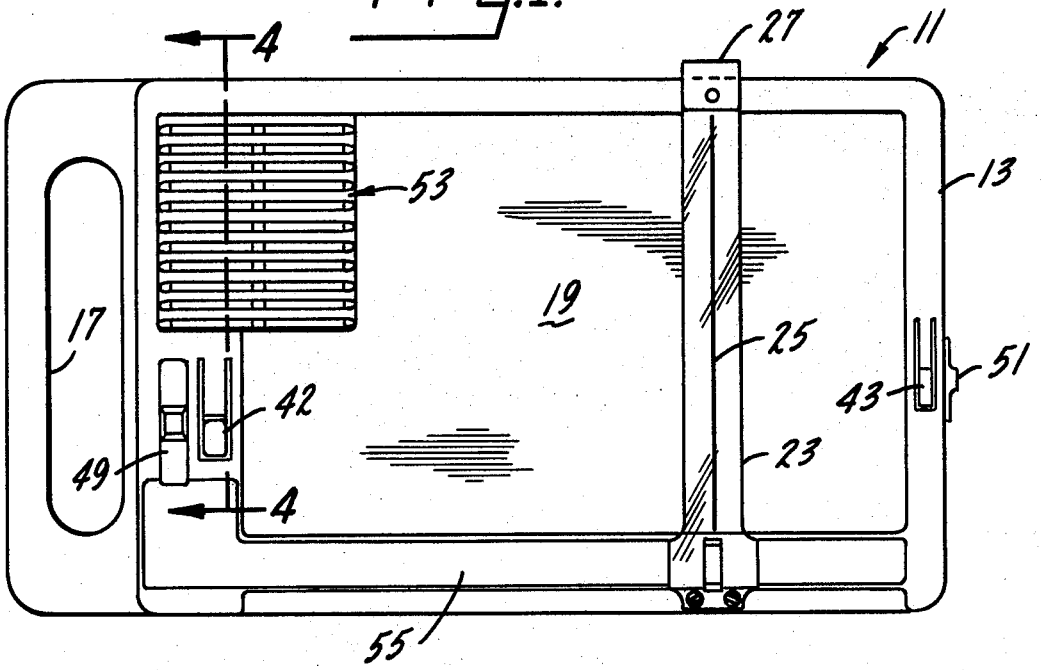
Fig. 2.
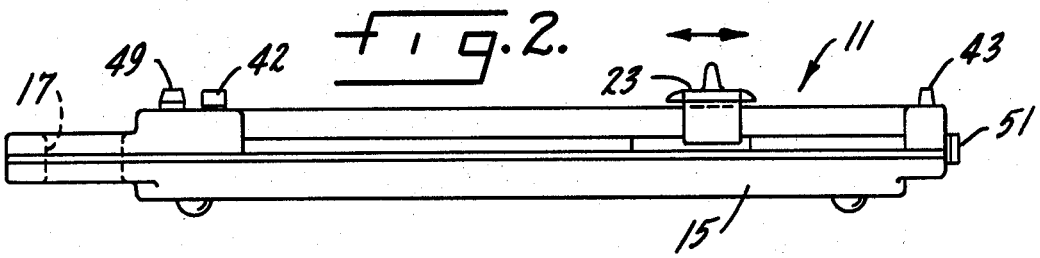
Fig. 3.
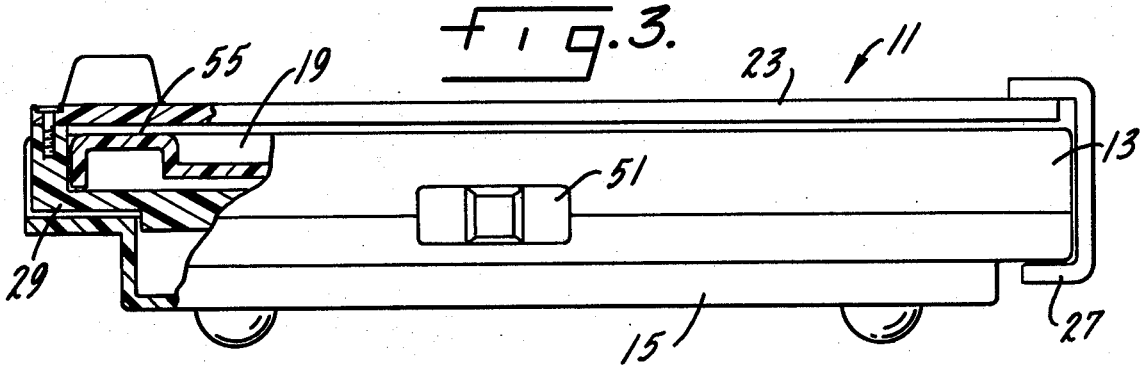
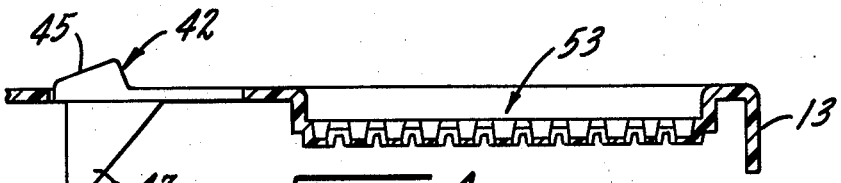
Fig. 4.

MUSICAL INSTRUMENT

BACKGROUND OF THE INVENTION

Present low-cost musical instruments can be classified as blown such as harmonicas, bugles, horns; mechanical such as toy xylophones, toy pianos; electro-mechanical such as toy organs powered by battery and electric motor driven blowers; or electronic such as the Casio Model VL TONE.

These instruments display a number of serious disadvantages. Probably the largest single disadvantage common to all these instruments is that in order to play a tune, they require the user to coordinate the motions of multiple body parts, such as fingers, with a score or code showing the sequence of operations needed to produce a tune. Thus, to play the toy piano or the toy organ, the user must strike a series of keys in the proper succession; using multiple fingers if the notes are to smoothly join, and the instructions for this sequence are in the form of notes on a score, or colors on a card, or numbers on a card which in general are physically separated from the keys. Thus, red, or the number 7 must be associated with the striking of a certain key with a certain finger (or covering an air hole, or hitting a bar with a certain hand) and then directly the next code, be it blue or 9 or whatever must be translated to another key struck by another finger or a different fist. These demands on the user's concentration and physical coordination are difficult and require a period of training even for adults of average dexterity. For children or persons of lesser dexterity, they can be overwhelming.

A second major disadvantage of these instruments is the poor quality of the tone produced. Toy or inexpensive instruments do not sound like their real counterparts, and in fact they do not even sound very pleasant, being more noise than music.

A third major disadvantage is their inflexibility, such instruments generally having only one mode of play simulating some one real instrument, that instrument being playable in only one of its styles or modes.

Those few instruments which add versatility and quality such as the Casio Model VL TONE do so at a vastly increased cost, and in the case of the Casio, considerable difficulties in setting up the instrument and playing it.

Another major disadvantage of present instruments is the inability to hold a note while a new note is being selected.

A disadvantage of electrical/electronic instruments is the use of failure prone switching, said switching requiring multiple conduction path makes and breaks to select a note or set-up an instrument.

Yet another disadvantage is the inability to produce the range of effects necessary to simulate instruments accurately, such as vibrato, tremolo, wow, attack time and decay time.

Still another such disadvantage is the inability to produce special effects such as riffles, broken chords, creation of new instrument sounds, automatic note repeat, etc.

It has been discovered that all of these disadvantages can be overcome by a novel electronic-mechanical device in which a unique songcard, a mechanical registration method, a mechanical slide coupled to a special array switch, and an electronic circuit are combined.

An object of this invention is a musical device which can produce a pleasant tune with continuous note production (sound output), said tune being provided with the instrument on a songboard, when played by a user of only average dexterity, including children, said users being without prior experience or training either on this device or on any musical instrument.

One object of this invention is a song annotation in which notes which are linearly connected in the sequence in which they are to be played are also positionally disposed to coincide with that position of the actuating slide which will produce the desired note, such that playing consists of moving a slide along a continuous path pausing at annotated points.

Still another object is to produce music of pleasant quality having accurate pitch and good timbre.

Yet another object is to simulate a number of different instruments, to allow different modes (such as a glissando mode in which all notes play briefly as they are swept through in going from one sustained note to a different sustained note), to allow instrument groups in which instruments play one-at-a-time alternately, and to allow special effects of many types.

One more object is to provide reliable switching in a musical instrument.

One additional object is to provide a high quality musical instrument economically priced to qualify as a toy, but with quality and versatility to be of interest to persons of all ages.

BRIEF DESCRIPTION OF THE DRAWINGS

The invention is illustrated more or less diagrammatically in the following drawings wherein:

FIG. 1 is a top plan view of a musical instrument embodying the novel features of this invention;

FIG. 2 is an end elevational view of the musical instrument of FIG. 1;

FIG. 3 is a side elevational view of the musical instrument of FIG. 1 on an enlarged scale with portions broken away and others shown in cross section;

FIG. 4 is an enlarged cross-sectional view taken along line 4—4 of FIG. 1;

GENERAL DESCRIPTION OF THE INVENTION

Figure 6:
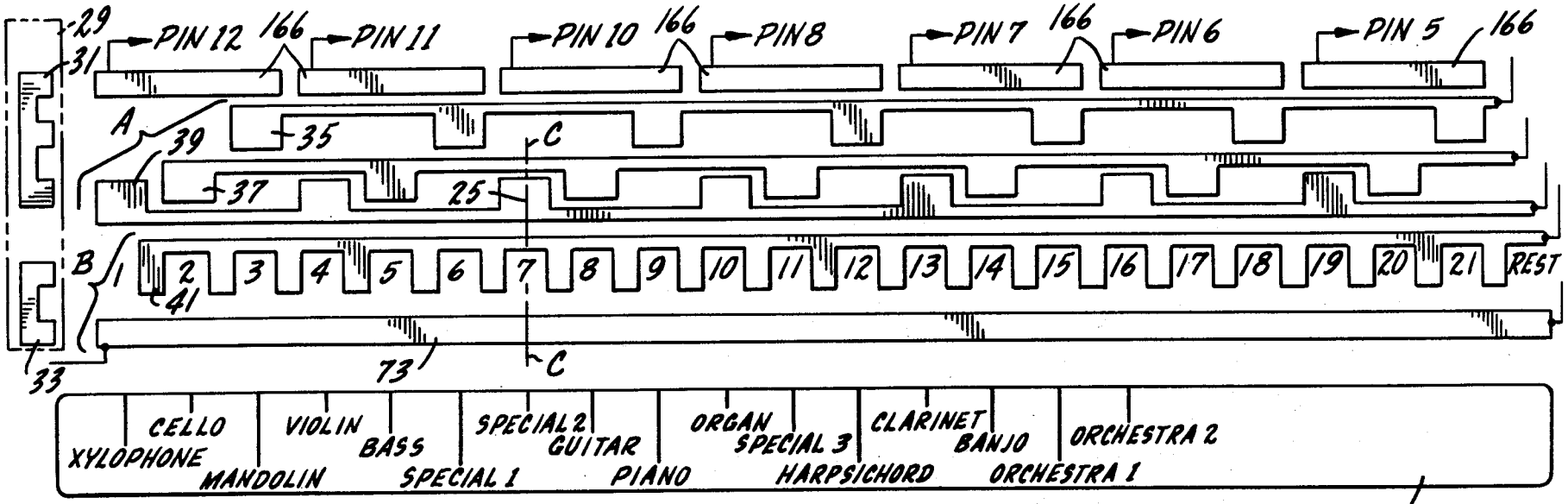
FIG. 6 is a schematic view of the slide switch contacts.

The novel solution to the foregoing problems and the realization of the aforementioned objectives has been achieved by combining a songcard, a slide coupled to an array switch, a housing which registers the songcard, the slide, and the array switch with reference to each other, a digital state machine which responds to the switch array and several auxiliary switches to produce outputs which through several transistors, resistors and capacitors, and diodes drive a loudspeaker.

The songcard is a generally rectangular piece of paper or cardstock on which the notes are printed as symbols such as circles or dots, each in a left-right position corresponding to pitch and in an up-down position corresponding generally to sequence of play, said notes being linked in sequence of play by a printed line which will in general define a serpentine pathway from start to end of a song. This arrangement of symbols can also be referred to as a matrix of columns and rows. The note annotations are generally varied for duration, the words may be printed below the notes, and other instructions such as instruments recommended or tempo and various art may be printed on the songcard. The edges of the songcard register with the walls of a well provided on the housing. A slide moves along this well, supported by the housing. A printed circuit board, registered to the housing in any conventional manner such as by bolts extending through the board and into bosses onto the housing bears a switching array which is also registered to the housing and thus to the songcard. An electrical contact carried by the slide contacts the switch array on the printed circuit board. Thus, when the note position and slide are in coincidence, the electrical contact of the slide is at a known point on the switch array where it will call for the appropriate note from the digital state machine. The output of the digital state machine is translated to music by the other components and the loudspeaker.

Only a single hand of the player is needed to move left and right registering the cursor line on the slide with each note in turn as the player's eye follows the continuous interconnecting path from note to note.

As the slide moves, thus moving its electrical contact, it operates two related but electrically isolated switching circuits. The "A" circuit makes a single closure at a time, closing one of three driven busses to one of seven input lines, for a total of 21 possible positions. Since only a single closure is made, there is no switching skew problem and there is no debounce problem. If a closure is sensed, then it constitutes a proper code. If no closure is sensed, then the digital state machine keeps searching for one.

The "B" circuit is a single closure which occurs before the "A" circuit changes state (or opens) and which reopens after the new "A" state is established. The function of the "B" closure and reopen is to signal the "A" change of state.

The device has a choice of two modes:

In mode one, an established note will continue until there has been a closure and reopen on "B" followed by a period with no further activity on "B". Thus, if the slide is on note five, and note five is established and playing, and the slide is moved toward higher notes rapidly, note five will continue playing until the slide stops and rests. Circuit "B" will now show a lack of activity, and will be open, assuming the slide is at a note position, and a new note will be established. The intervening notes were never established because there was not a sufficiently long period of inactivity on the "B" circuit. This novel arrangement allows the playing of widely separated notes without a corresponding time gap between the sounding of the notes, and without the sounding of the intervening notes. In mode two, a new note is established directly upon the reopening of the "B" circuit. Thus, the sounds are contiguous in a temporal sense, and all intervening notes play producing a glissando. The choice of modes is controlled by a switch which communicates a signal of one bit to the digital state machine.

The positions of the slide are normally interpreted as notes. There are twenty-one note positions plus a position at one far end for which no "A" circuit closure occurs. This position is silent, producing a rest. A closure of a momentary "SET" switch transmits one bit to the digital state machine, causing it to interpret the then slide position as an instrument setting position. Sixteen of the twenty-one note positions are so double used, corresponding to eleven traditional instruments (xylophone, cello, mandolin, bass, guitar, piano, violin, harpsichord, organ, clarinet and banjo), three special effects, and two orchestra positions. Any of these sixteen choices can be made at any time by positioning the slide to the desired position and momentarily actuating the slide to the desired position and momentarily actuating the "SET" switch.

The orchestra positions are a novel feature in a musical instrument or device. Each consists of a set of four instruments. These instruments play cyclically. When orchestra is selected, notes will play in the voice of instrument one of the orchestra group. When the "NEW INSTRUMENT" switch is momentarily closed, transmitting a bit to the digital state machine, then the next note to be played will be in the voice of instrument two of the selected orchestra group. Three follows two and four follows three similarly. Next, one follows four, etc. Each closure of the "NEW INSTRUMENT" switch causing an instrument change to occur on the next note to be played. This preset feature is also novel and allows the instrument change to occur in a smooth fashion without demanding coordination on the part of the user.

Thus, the input information of the digital state machine consists of the "A" and "B" circuits, the "SET" bit, the "GLISS" bit, and the "NEW INSTRUMENT" bit.

Four output bits from the digital state machine drive a four-bit digital-to-analog convertor which is followed by a capacitor which both sets attack and decay in conjuction with the four-bit digital-to-analog convertor and acts as a low-pass filter in conjuction with a resistor. A fifth output bit overrides the limited attack rate of the digital-to-analog convertor and forces an almost immediate attack to full amplitude (for example for a piano sound). A sixth output bit overrides the previous five bits and forces the function to zero thus immediately stopping the sound (abrupt halt). The six output bits together establish the sound envelope.

Two additional output bits, weighted two-to-one, modulate the envelope at an audio rate or rates established by the digital state machine. This audio signal is current amplified by three emitter followers and applied to a speaker.

Three additional outputs from the digital state machine drive a three-bit digital-to-analog convertor, the output of which is integrated and applied through a resistor to the RC (resistor-capacitor) clock which operates the digital state machine. Thus, the state of these three outputs of the digital state machine determines the clock rate of the digital state machine. The clock rate in turn determines the pitch of the note. The higher the clock rate, the higher the pitch of the note. The integration is essential, both for musical reasons, and to prevent abrupt clock changes which could disorganize the digital state machine. The function of this circuit is to provide vibrato and other changing frequency effects. The integration smooths the inherent step functions in the digital output and makes for a pleasing vibrato.

The six envelope control bits, in addition to controlling attack time and decay time, produce silence, wow (amplitude oscillations), tremulo (combined with the frequency control bits), etc.

The two audio rate bits control the basic pitch of the note, the amplitude (by operating both bits, the low-weighted bit only, or the high-weighted bit only), and the timbre of the note by operating the bits in a cyclic pattern with internal structure. The pattern repetition rate determines the pitch and the pattern structure determines the timbre of the note.

An instrument is simulated by selecting appropriate behavior for the envelope control bits (thus for a piano, immediate full amplitude attack, and medium decay to zero), for the frequency control bits (for a piano, fixed frequency-no vibrato, etc.), and for the audio rate bits (modest timbre structure for the piano). Additionally, the frequency range is adjusted for the instrument selected. Thus, the twenty-one note range is different for different instruments. As another example, the violin has a moderate starting amplitude which swells to full amplitude, moderate vibrato, no decay (continuous tone production), a pure voice (no internal structure), and a high pitch range.

The various instruments are represented as tables in the digital state machine, the proper table entries being called-up by an instrument "SET" or "NEW INSTRUMENT".

The required digital state machine could of course be realized by assembling sufficient counters, registers, logic gates, etc., and organizing them into high speed functional groupings each dedicated to one of the tasks required, such as operating the audio rate outputs, operating the frequency control outputs, operating the envelope control outputs, reading the "A" circuit, monitoring the "B" circuit, monitoring the "SET" bit, monitoring the "GLISS" bit, or monitoring the "NEW INSTRUMENT" bit.

It has been discovered that the very high rates necessary to produce audio output can be reached with a single set of hardware which can also perform all of the other required functions without ceasing the production of audio or changing the pitch of the produced audio by properly organizing the digital state machine. The requisite organization, an organization unique to electronic music devices, is to produce a portion of the time delay which corresponds to the shortest unit time in the audio pattern being produced, to produce the next output state from the cyclical output table, then to jump to the next task of a list of tasks and perform that task, then having advanced the task counter and the output state counter to repeat the cycle. The tasks must be of constant time length, all equal, and this must be true regardless of execution path through the task, a requirement which is met with a series of time delays. This fixed part length adds to the variable time delay to determine the pitch (through the unit pattern length). The fixed path length through the tasks added to the minimum length through the variable note delay determines the shortest delay and thus the highest pitch producible.

There are many combinations of hardware which could realize the foregoing organization and thus be used to construct this device. However, for economy and simplicity, a preferred embodiment uses a National Semiconductor Microprocessor, COP421, with options according to Table I and ROM values according to Table II.

DETAILED DESCRIPTION OF THE PREFERRED EMBODIMENT

Figure 7:
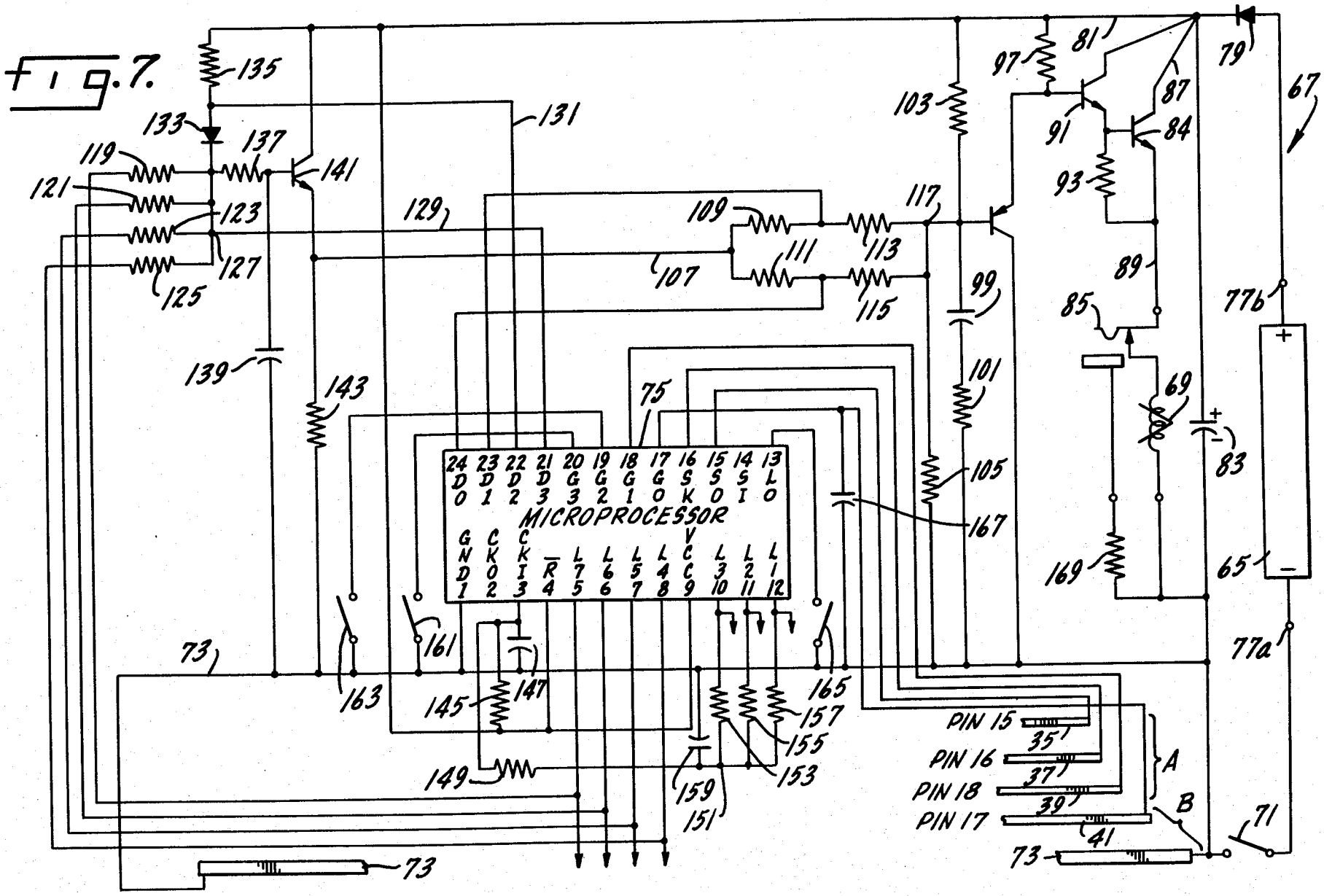
FIG. 7 is a schematic view of the electronic circuitry of the musical instrument.

FIGS. 1 to 3 of the drawings show a hollow housing 11 conveniently formed of top and bottom plastic sections 13 and 15 respectively which may be fastened to each other in any conventional manner. The housing is relatively flat and rectangular in shape and has a handle opening 17 formed at one end thereof. A depressed well 19 of generally rectangular shape is formed on the upper surface of the top housing section 13 and is adapted to receive and register a songcard 21 (shown in FIG. 5) relative to the housing. A slide 23 is mounted on the housing and is adapted to be moved across the depressed well 19 in the directions shown by the arrows in FIG. 2. The slide is preferably formed of a transparent material and has a guide line 25 formed thereon. One end of the slide has a U-shaped clamp 27 fastened thereto which clamps fits over the edge of the housing in the manner shown in FIG. 3. A support 29 for electrical contacts 31 and 33 (shown in FIGS. 3 and 6) is attached to the opposite end of the slide and extends into the interior of the housing 11 where the contacts can be moved along the lengths of the stationary electrical contacts 35, 37 and 39 of the "A" circuit and 41 and 73 of the "B" circuit which form part of the switching array and are shown in FIGS. 6 and 7. These circuits may be conveniently formed on the surfaces of a printed circuit board (not shown) which is positioned in the housing in alignment with the path of travel of the slide electrical contacts support 29.

Cantilevered finger operated levers 42 and 43 are molded in the top section 13 of the housing 11. As shown in detail for lever 42 in FIG. 4, each lever has a finger engaging button 45 on its upper surface and a downwardly extending leg 47 which engages a momentarily actuable switch, preferably a laminated plastic electric switch, which is not shown other than in the schematic of FIG. 7. Slidable handles 49 and 51 are mounted on the top section 13 of the housing and are used to operate electrical switches of the instrument which are shown in the schematic of FIG. 7.

A grill 53 shown in FIGS. 1 and 4 is formed in the top section 13 of the housing 11 and provides openings into the interior of the housing to permit the escape of heat and sound therefrom. An irregularly shaped raised surface 55 shown in FIG. 3 is located along one side of the tip section of the housing beneath one end of the slide 23 and is adapted to receive a decal 56 shown in FIG. 6 which identifies special effects which may be obtained at various positions of the slide and the switch functions for lever 42 and handle 49.

Figure 5:
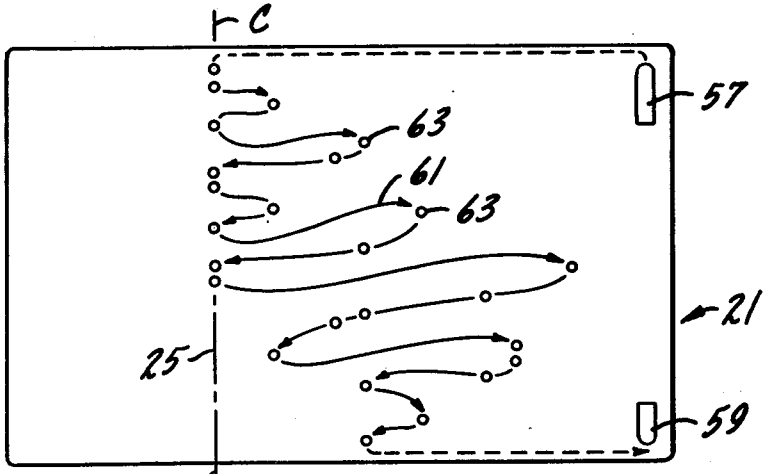
FIG. 5 is a top plan view of a note card.

A songcard 21 is shown somewhat schematically in FIG. 5. Printed on a surface of the songcard, which may be made of card stock, heavy paper or plastic, are a start position 57 and an "off" or "end " position 59 connected by a printed trace line 61. The start and end positions are located on one side of the songcard in alignment with each other relative to the slide guide line 25. The trace line connects notes 63 which are printed on the songcard. The notes may be of different shapes such as circles or dots or even colors to indicate different durations, etc. but all notes of the same frequency will be positioned so that they will be aligned with the slide guide 25. The notes will vary in frequency from the left hand side of the songcard to the right hand side as shown in the drawings. Printed instructions, art work and words for the songs may also be printed on the songcards but are not shown in the drawing for clarity of illustration.

The alignment of the stationary electrical contacts of the array circuits A and B with the instruments and other effects listed on the decal 56 and the columns of indicia 63 representing notes of different frequencies on the songcards 21 is dispicted in FIGS. 5 and 6 of the drawings. For example, when the guide line 25 of the slide 23 is aligned with the indicia on decal 56 labeled "Special Effects 2" and with a column of indicia 63 on the songcard, it is aligned with one of the stationary electrical contacts of path 39 of array circuit A. The movable electrical contact 31 of the slide is in electrical engagement with this stationary contact. For convenience of illustration, this alignment is shown by reference line C in FIGS. 5 and 6. Normally, the notes indicated by the indicia 63 on the songcard will be played. However, if lever 43 has been actuated to close switch 165 (hereinafter described) the notes will be played in the voice of special effects 2.

The array circuits A and B and the circuitry connecting these circuits to a power source 65, a digital state machine 67 and a loudspeaker 69 are shown in FIGS. 6 and 7. The power source 65 consists of five AA batteries arranged in series to provide a 7.5 volt DC output. An on/off switch 71 operated by slidable handle 51 is connected to the negative side of the power source and to the common ground connector 73.

The digital state machine 67 includes a microprocessor 75. A suitable microprocessor is a COP421 manufactured by National Semiconductor Corp. of Santa Clara, Calif. and further described in their bulletin COP420/421 Single-Chip N-Channel Microcontrollers. This microprocessor has 24 pins or leads numbered 1 through 24. Lead 1 is a ground lead and connects to the common 73 of the device circuit, symbolized by 0 V (zero volts, therefore the potential reference point for all circuit voltages). This circuit common 73 connects to the negative most lead 77*a* of the 5 AA cells 65 through on/off switch 71. The positive most lead 77*b* of the 5 AA cells 65 connects to ½ amp silicon power diode 79, which offers protection against damage from accidental polarity reversal, to positive supply bus 81. Capacitor 83, an aluminum electrolytic 100 microfarad capacitor rated at 10 working volts connects between buses 81 and 73 providing power supply decoupling and filtering.

Transistor 84, a Motorola MPS2222, drives speaker 69 through external speaker jack plug 85 via connecting leads 87 and 89. Plugging an external speaker into jack plug 85 disconnects speaker 69 and transfers the output to the external speaker. Transistor 91, a Motorola MPSA20, drives transistor 84. Resistor 93, 4700 ohms, acts as a base return for 84. Transistor 95, a Motorola MPSA70 PNP drives transistor 91 with 10 kilohm resistor 97 acting as an emitter load for transistor 95. All three transistors are connected as emitter followers, and act to transform the 8 ohm impedance of speaker 69 to a value in the several hundred thousand ohm region.

Capacitor 99, preferably a 0.0033 microfarad ceramic or polyester, and resistor 101, preferably a 47 kilohm resistor, connect in series from the base of transistor 95 to the 0 V buss 73, act to modify the frequency response of the amplifier system for a more pleasant sound. Resistors 103 and 105 adjust both the amplitude and voltage offset at the input to the amplifier comprising 95, 91, 84 and associated parts, so as to obtain linear amplitude performance. Voltage on conductor 107 is applied to 10 kilohm resistors 109 and 111 which connect respectively to 220 kilohm resistor 113 and 100 kilohm resistor 115. The voltage at 117, the base of transistor 95 will depend on the voltage applied to 107 and the states of the microprocessor output on 75-pin 24 also called D0 which connects to the junction of 111 and 115 and is an open collector (sinking) output, and the output on 75-pin 23 also called D1 which connects to the junction of 109 and 113 and is similarly open collector (sinking). When these outputs are on (conducting), the voltage at 117 is the offset voltage established by 103 and 105. When either output is off (non-conducting), its respective resistor branch contributes a current proportional to the voltage at 107 thus creating a voltage at 117 which drives speaker 69. When D0 and D1 switch on and off at audio rates, the speaker 69 is driven at those audio frequencies. Thus, one or two basic audio pulse rates are possible since D0 and D1 can have different switching rates, and three different drive amplitudes are possible for any given voltage at 107 since the two branches have differing resistors. Stated another way, the microprocessor output ports D0 and D1 establish the audio waveform.

Since the audio drive is proportional to the voltage at 107, this voltage establishes the audio envelope (attack, amplitude, and decay, etc.) Resistors 119, 121, 123 and 125 of values 100 kilohms, 220 kilohms, 470 kilohms and 1 megohm respectively, and connected to microprocessor ports L7 75-pin 5, L6 75-pin 6, L5 75-pin 7 and L4 75-pin 8, respectively, form a 4-bit DAC (digital-to-analog convertor). The voltage at common point 127 will be a function of the input state to this DAC. Conductor 129 connects common point 127 to microprocessor port D3 75-pin 21. This open collector (sinking) output port when conducting will override the DAC output, forcing the voltage at 127 to zero and silencing the output from the speaker. Conductor 131 connects microprocessor output port D2 75-pin 22 to common point 127 through 1N914 type diode 133. When open collector (sinking) output D2 is off, resistor 135 applies current from positive buss 81 to common point 127 through diode 133, overriding the DAC and causing full output from 127. 4.7 kilohm resistor 137 and capacitor 139 of value 0.22 microfarads and preferably polyester, form a low pass filter to stop extreme transients from reaching the base of transistor 141, a Motoroal MPSA20. Transistor 141 and its emitter load 143, a 10 kilohm resistor, act as an emitter follower to transfer the voltage from the filter 137–139 to line 107. Thus, the audio waveform envelope is determined by the states at microprocessor ports D2, D3, L4, L5, L6 and L7. D3 conducting (logic zero) turning all sound off (immediate cutoff) and overriding the other ports, D2 turning sound full on at an attack rate limited by 135, 137 and 139, and overriding all except D3, and L4, L5, L6, and L7 establishing attack rate, decay rate, and amplitude provided D2 is conducting (logic zero) and D3 is non-conducting (logic one).

Microprocessor 75 has a clock rate which is established by 10 kilohm resistor 145 connected from positive bus 81 to clock input pin (also called CKI) 75-pin 3 and 100 picofarad capacitor 147, ceramic, mica, or polyester, connected from CKI pin 75-pin 3 to 0 V bus 73. This clock rate is modified (modulated) by current flowing through 47 kilohm resistor 149 connected from 75-pin 3 to the common point 151 to a DAC consisting of 47 kilohm resistor 153, 100 kilohm resistor 155 and 220 kilohm resistor 157, driven respectively by microprocessor ports L3 75-pin 10, L2 75-pin 11, and L1 75-pin 12. A 2.2 microfarad aluminum electrolytic capacitor 159 connects from the common point of the DAC 151 to 0 V bus 73 and thus filters the voltage at 151 causing the frequency modulation of the microprocessor clock to be substantially triangular with time (approximately linear frequency versus time). This modulation of the microprocessor clock will in turn time modulate all internal processes and thus all microprocessor produced signals providing such effects as vibrato.

75-pin 9 is the Vcc input for the microprocessor and connects to positive buss 81 as does reset pin 75-pin 4. Clock output CKO 75-pin 2 and SI input port 75-pin 14 are not used.

Port G3 75-pin 20 is used as an input and connects to bus 73 through switch 161 operated by lever 41 signalling the microprocessor to produce either notes selected by pausing the selector, or all notes passed over by the selector (glissando).

Port G2 75-pin 19 is used as an input and connects to bus 73 through switch 163 operated by slidable handle 49 which signals the microprocessor to change to a new instrument simulation by being momentarily closed. This feature is used in conjuction with the orchestra feature.

Port L0 75-pin 13 is used as an input and connects to bus 73 through switch 165 operated by lever 43 which signals the microprocessor to select (set) an instrument to be simulated by being momentarily closed.

Ports G1, SK, and S0, 75-pin 18, 75-pin 16, and 75-pin 15 respectively are used as outputs to drive (scan) switch contacts 31 and conductors 39, 37 and 35 respectively, all of which are parts of the array switch. Ports L1 through L7 75-pins (12, 11, 10, 8, 7, 6, 5 respectively) are used as inputs from scan lines 39, 37 and 35. The electrical contact 31 of the slide 23 engages one of the stationary contacts 35, 37 or 39 and one of the stationary contacts 166 which is connected to a particular one of pins 5, 6, 7, 8, 10, 11 or 12. This 3-to-7 switch array has 21 possible single contact states which are established by the position of the slide contact 31, each state representing either a note or an instrument selection, depending on the state of switch 165. A closure of switch 165 selects an instrument (or orchestra instrument group) based on the position of the slide contact. If switch 165 is open, then the slide contact 31 selects notes.

Port G0 75-pin 17 is used as an input and connects to bus 73. As slide contact 31 moves between selection positions, contact 33 momentarily connects buss 41 to bus 73, signalling the microprocessor 75 that a new selection of note will shortly occur. Capacitor 167 connects from bus 41 to bus 73 and has a value of 2.2 microfarads. This capacitor insures that the bus 41 will remain at a low voltage long enough for the microprocessor to record it.

Resistor 169 protects the internal circuit in case of a short in an external speaker, and has a preferred value of 22 ohms.

A typical operating program for microprocessor 75 is located at the end of this specification. An explanation of this program identified by line number is as follows:

The program source code is written in National Semi-Conductor's macro-assembler language for its COP421 microprocessor.

Lines 1–5 instruct the assembler as to title, printing instructions, chip (microprocessor) type, and force a noassemble condition for the following blocks lines 19–169 (an alternative to line-by-line comment symbols).

Lines 19–33 include a brief description of the hardware.

Lines 36–39 adapt the code to either an old (oldpc=1) or new (oldpc=0) pc board layout. Final product uses the new layout, thus oldpc=0. This selection affects lines 153 through 169 which provides two alternative sets of assignments depending on pc layout.

Lines 41 through 110 assign names to the various RAM cells of the COP 421. These cells can then be referred to in the assembly code by name.

Lines 113 through 150 similarly assign a variety of names for convenience in writing assembly code.

Lines 171 through 183 constitute a macro which does the manipulation necessary to prepare a "voice" table.

Lines 187 through 199 start the code proper. These lines clear the RAM to all 0's.

Lines 632 through 765 and 953–961 initialize the parameters which cause the music to have the characteristics of a specific instrument. 632–649 are common to all instruments. 650–653 do an indirect jump based on the contents of the LEVAL RAM cell (Low Evaluation). The jump will go to an instrument such as Violin (line 655) or Cello (line 667) with the table at 539–555 controlling the jump destination.

The parameters dealt with include Amplitude, Swell, Decay, Vibrato, Staccato, Wow, Voice, Pitch, and Special Effects.

After setting the instrument by initializing the appropriate RAM cell values, the code jumps to DSNG lines 202–236, 851–857, 923–927, and 950–952. The first time through, this code plays a little 'song' in the voice of the first instrument (piano). The song is stored at the song table 919–921. After playing the song, this code sets SNGCNT to cause future passes to skip playing the song.

Lines 240–268 read a note from the keyboard. SLDCNT is a RAM counter telling time elapsed since the slide moved to a new note. It controls the transition to a new note. RDNT clears this nibble of RAM and then reads the keyboard (subroutine RDKB). 250 tests the Glissando bit (input G3) to control the between notes delay (sub DLYMAX). 255–256 clear the elapsed time register (LELPTM/HELPTM) which keeps track of time since last note was changed and cause return to the song after an interval to protect against battery exhaustion due to the player forgetting the unit is turned on. 258–260 clear a RAM timer. 262–267 handle the change of instruments in orchestra mode, along with 1388 through 1402.

Lines 271 through 338, and 1364 through 1382 set the parameters needed to produce a new note. These include the base pitch from which the note pitch will be calculated (278–289), the special effects mechanism which utilizes an ESCAPE nibble and manipulates BPITCH according to a table at lines 774 through 783 which is read by the sub at lines 795–797, said special effects being setup by 290 through 301, the decay and swell mechanisms handled by lines 302–329, the establishment of the new note value handled by 330 through 338 and 1364 through 1372 which call the sub STNDL (set tone delay) at lines 889 through 910. This sub reads the note table at 866 through 883. Finally 1373 through 1382 set pointers to the voice table which is located at 936 through 949 and establishes the output waveform and thus the timbre.

Lines 339 through 531 are the subroutine pages and include math subroutines (complement, add, subtract, etc.), delay subroutines which insert instructions to cause time delay to equalize the running times through various paths to prevent jitter in the note production, and specialized subroutines. Notice that the $DLY_{13}$ subs chain for word usage efficiency. The $JSD_{13}$ subs do a delay and then go to SPKOUT instead of doing a subroutine return. These subs are used as equalizers in the note production path and not as general purpose delays. They use the subroutine mechanism as an efficiency convenience (one-byte call) and not as a true subroutine. This is a novel feature of this program. PRRDL (441–442, 471–475, and 486–491) prepares for a read of the L port. RDLP (444–445, 476–491) reads the L port. These subs return through a delay for word usage efficiency only. EVBY (447–449 and 494 through 517) evaluates the L port read by reducing the input image which has been read into a byte of RAM to a number in a nibble. The subroutine RDKB at lines 557–602 does all portions of the keyboard read and evaluation, calling subs to clear the receiving nibble, prepare to read the L port, setting the keyboard strobe (SO, SK, or G1), calling sub to read L, and evaluating the resulting byte. Since the keyboard is based on only one closure per note, the first closure ends the read. If no closure is found, the read routine loops and continues looking (line 586). When RLRDKB RAM register overflows, the loop terminates by jumping to MREST (rest), lines 603–611 which set DMASK to O to silence the sound and then jump to the sound producing loop (which will now however be silent) which loop monitors slide for signs of activity.

The sound producing loop begins at 966. Lines 966 through 993 produce an output at the D port to create the desired audio waveform in accordance with the VOICE table and produce an output at the L port to drive the amplitude and frequency modulation DAC's. (DAC=Digital-to-analog convertor). The code continues with 999 through 1018 which is a time delay generator and produces a delay in accordance with the note value desired thus setting the time around the loop and the pitch. This delay scheme uses a delay sub DLY251 at 1341 through 1353 and a delay sub DELA11 at 1359 through 1362. The tone delay exits to L1ML at 1064. TMFLGS, a RAM flag controls the flow to either TIMER or TASK. As long as the flag is one, the flow is to TIMER, at 1023, where a real time clock is tested (SKT) and if expired, then the real time timer nibbles in RAM (LTIMER, HTIMER) are updated and the TMFLGS Is set for task. At each pass through the timer GO is tested to see if the slide has moved. If the slide is Low (GO low) then SLDCNT is set to 1. If the slide is up (GO high) SLDCNT is tested. If it was zero, no change is made (GO must go low before SLDCNT can advance). If it was one, it is set to two. If it was two or more, it is left as was. In Glissando mode, if the count is two or more, the timer goes to DSNG to begin a new keyboard read. Otherwise, timer exits to SPKOUT for another loop.

If ML goes to DO TASK, then the program will jump through a task table, based on the contents of LTIMER the real time timer. Thus each real time advance returns the flow through DO TASK and causes the next task to execute. In between tasks the flow is through TIMER waiting for the real time clock. Because of this, the tasks execute at a fixed rate regardless of the note pitch (the rate of the loop being inversely proportional to the pitch).

Lines 1073 and 1074 cause the jump through the table at 1082 through 1086. Not all of the jumps are normally used. There are sixteen jump designations in four lines and the LTIMER accesses them in order as it goes from 0 through 15, but task SERT (service timer) resets the timer to 2, so the last two SERT tasks would not normally be reached nor would the leading two SERTS.

ELPT 1140 through 1151 advances the elapsed timer to operate the warning tune is the instrument is left unused but with power on.

SWLL 1203 through 1231 operates the swell mechanism causing the sound to swell from said initial value to full amplitude at some rate, provided swell is called for based on the INIT.

If WOW is called for, WWOW 1237–1247 causes the amplitude to wow up and down.

TELP 1267–1283 tests the elapsed timer and if it overflows jumps to START causing the initial song to play and warning the user that power is still on.

VIBR 1104–1115 operates the vibrato if called for.

If decay is called for DDEC 1119–1138 provides it, causing the amplitude to decay at some rate.

Note: Vibrato is a linear up and down frequency modulation.

RDLS reads the L port into LLIN, 1091–1095.

TSLS 1172–1180 tests for a call for new instrument. If LO was read in low into LLIN lines 1177–1180 jump to DSET 613–631, which reads the keyboard for the new instrument information and goes to INIT. If G2 is low lines 1173–1176 set a memory flag and if in orchestra mode than an instrument change will occur on the next new note.

SLDC 1185–1200 tests slide count, (RAM cell SLDCNT) and if it is not equal to zero advances it. If it overflows, the program branches to DSNG and a new note.

TESC 1255–1264 tests HTIMER and ESCAPE and escapes the loop to DESC for special effects.

SNGE 1330–1339 does special effects during the initial song.

SERT 1319–1327 services the timer, advancing HTIMER and resetting LTIMER.

DESC lines 799 through 850, and 1284 through 1314 create the special effects such as ping-ponging between two notes, producing a short lead note, producing a twang in front of a note, and producing a cascade of notes up or down the scale.

The foregoing program may be modified if the production microprocessors vary from the prototype.

While the foregoing describes a preferred embodiment, many other embodiments within the spirit of the invention will be obvious to those skilled in the art.

TABLE I

| OPTION | VALUE |
|---|---|
| 01: GROUND | = 00 |
| 02: CKO OUTPUT | = 02 |

| | | |
|---|---|---|
| 03: | CKI INPUT | = 04 |
| 04: | RESET INPUT | = 00 |
| 05: | L7 DRIVER | = 00 |
| 06: | L6 DRIVER | = 00 |
| 07: | L5 DRIVER | = 00 |
| 08: | L4 DRIVER | = 00 |
| 09: | NO CONNECTION | |
| 10: | NO CONNECTION | |
| 11: | VCC | = 00 |
| 12: | L3 DRIVER | = 00 |
| 13: | L2 DRIVER | = 00 |
| 14: | L1 DRIVER | = 00 |
| 15: | L0 DRIVER | = 00 |
| 16: | SI INPUT | = 00 |
| 17: | SO DRIVER | = 01 |
| 18: | SK DRIVER | = 01 |
| 19: | NO CONNECTION | |
| 20: | NO CONNECTION | |
| 21: | GO I/O PORT | = 00 |
| 22: | G1 I/O PORT | = 01 |
| 23: | G2 I/O PORT | = 00 |
| 24: | G3 I/O PORT | = 00 |
| 25: | D3 OUTPUT | = 01 |
| 26: | D2 OUTPUT | = 01 |
| 27: | D1 OUTPUT | = 01 |
| 28: | D0 OUTPUT | = 01 |
| 29: | COP FUNCTION | = 00 |
| 30: | COP BONDING | = 01 |
| 31: | NOT AN OPTION | |
| 32: | G INPUT LEVEL | = 01 |
| 33: | L INPUT LEVEL | = 01 |
| 34: | CKO INPUT LEVEL | = 01 |
| 35: | SI INPUT LEVEL | = 01 |

TABLE II

RØM VALUES:

| | | | | | | | | | | | | | | | | |
|---|---|---|---|---|---|---|---|---|---|---|---|---|---|---|---|---|
| 000 | 00 | 12 | 00 | 04 | C2 | 12 | 5D | C1 | 29 | 78 | 61 | 57 | 0F | 33 | 3E | 23 |
| 010 | 0E | 51 | 84 | EE | 33 | 69 | 1A | 35 | 6A | A4 | 29 | 33 | 2C | 33 | A2 | 06 |
| 020 | 2A | 8D | 8E | 68 | CA | 23 | 22 | 5F | 61 | F5 | 9A | 0D | 96 | F5 | 0D | 96 |
| 030 | 69 | 10 | 33 | 13 | 9A | 33 | B6 | 93 | 3D | 70 | 93 | 2F | 13 | B4 | 60 | 43 |
| 040 | 11 | 63 | EE | 28 | 78 | 1F | 70 | 1C | 75 | 1C | 23 | 2E | 5A | 56 | 70 | 1D |

```
050   06 05 8B B3 00 5C 33 69 69 C9 3A 33 2C 1D 8B 0F
060   96 23 2F 5F 84 4D 23 1F 5F F0 47 1B 23 35 06 F6
070   01 46 1B 7F 28 7C 1F 01 63 DE 3B 23 1E 06 63 D7
080   06 40 06 99 49 22 89 32 00 40 8F 32 8F 22 00 30
090   44 36 48 06 00 36 06 00 06 92 00 F1 44 44 44 44
0A0   44 44 44 44 44 44 44 44 62 AD C0 C5 D6 33 B8 33
0B0   B1 33 B5 33 B2 D5 00 00 00 00 00 00 00 00 00 00
0C0   2C 05 33 3C CE 39 33 2E 36 06 1B 35 33 3C 33 5F
0D0   22 4F 33 6D 09 FB 68 80 00 13 57 03 56 11 55 01
0E0   54 39 68 80 13 53 03 52 11 51 5F 49 29 23 87 00
0F0   83 0D 33 01 68 84 71 41 F1 51 F1 F0 00 00 00 00

100   A5 72 7E 6A 75 A0 AF 78 93 98 B3 8C 89 86 BA B8
110   AD 93 29 93 AA 33 5D AB AC EE AA 32 4F AB AC EF
120   AA 33 65 AB AC F0 AD 00 54 8B 8E 20 D2 FA 51 51
130   06 69 35 69 35 23 07 8B 8E 48 23 0B 51 AB 28 70
140   3A 70 A8 33 A2 70 0A 7F AA AB 39 01 84 CB 69 10
150   19 00 21 63 95 2F 43 1A 74 2B 7F 7F 79 70 4D 1E
160   70 3F 70 70 70 B1 70 29 00 FF B1 78 1E 72 3F 71
170   60 0C AF 76 EA 2D 73 F2 2E 72 AF 77 75 F0 2E 78
180   AF 71 71 70 77 ED B3 78 ED 1E 78 ED 2E 78 B3 74
190   7D 76 ED 2E 72 AF 72 ED 1E 72 3F 75 73 B1 73 ED
1A0   2E 71 3F 75 ED 2E 74 3F 74 77 73 75 7C 60 0C B3
1B0   76 71 D3 B3 77 72 61 6A 62 A6 62 A9 00 00 00 00
1C0   00 F6 D0 F6 F0 F1 88 48 F0 BF 48 0E 96 23 32 40
1D0   55 EF 5E D6 3A 7F 1F 00 52 02 06 11 84 E3 1D 23
1E0   33 06 EA 1D 23 34 06 23 32 5C 60 5F 3A 70 EA 51
1F0   63 9A 1D 87 EC 0A 05 5F 62 4B 7F 61 3A 00 00 00

200   5B 77 8F A7 BF D3 E7 FB 0F 1F 2F 3F 4B 59 65 71
210   7D 87 91 9E A5 AD B5 BD C3 CA D0 D6 DC E1 E6 EB
220   F0 F4 F8 FC FF 33 69 0B 35 BF 38 33 2C 36 16 7F
230   0B 35 5F 84 48 05 58 84 48 18 7E 48 00 00 00 00
240   00 3A 5A 7A 8A AA CA EA FA 32 00 52 44 06 60 0C
250   00 00 00 00 00 00 00 00 00 00 00 00 00 00 00 00
260   00 00 00 00 00 00 00 00 00 00 00 00 00 00 00 00
270   00 00 00 00 00 00 00 00 00 00 00 00 00 00 00 00
280   10 03 30 21 50 61 72 43 90 A0 B3 C1 D0 E2 F1 01
290   12 20 31 83 50 62 71 82 90 43 B0 C2 D0 E1 F3 A3
2A0   10 22 31 03 BF 48 2F 46 EB 2F 42 63 EA 1C 32 05
2B0   30 F8 51 06 68 B5 62 C4 16 35 33 69 BF 33 2C 28
2C0   02 50 33 3E 1B 35 33 3C 33 6D 38 01 CE 44 35 52
2D0   CF 15 51 DB 05 51 D8 FA 6B C6 D5 6B D4 D2 41 F6
2E0   70 05 51 37 33 01 E9 71 A1 05 5F F9 5F 53 06 06
2F0   33 13 62 AD 60 0C 92 0D E4 A3 3D 01 DE 7F 00 FF

300   B4 B4 31 60 77 8A 15 20 10 48 52 7F BB B4 B4 B4
310   39 33 2E 06 9F 3F 00 52 01 58 03 54 2B 02 06 A5
320   0F 03 E4 9E 0E 01 A0 1B 23 2F 22 10 EF 06 A8 70
330   A8 33 96 22 00 53 30 44 26 00 30 06 A6 00 00 00
340   80 82 A0 94 88 88 9A 84 2F 33 03 11 47 39 01 A2
350   61 43 0D 00 21 D7 9F 00 55 22 30 DE 60 0C 06 A5
360   0F 11 03 F0 1B 23 1F 32 30 EE 7F 0F 45 A8 06 A6
370   01 F3 A1 46 28 42 A4 00 3F 03 54 1B 02 06 A2 0E
380   23 3B 5F 9F 51 22 30 A3 61 CB 33 B6 00 22 30 A0
390   00 36 00 30 D8 0F 60 00 06 A7 52 EF 28 7C 1F 4D
3A0   3A 7F 23 33 85 88 20 84 F2 28 43 3A 70 60 76 00
3B0   5C 9B 60 5F 0E 05 51 44 36 71 A1 33 A2 05 5F 51
3C0   52 84 60 0C 06 A6 23 87 00 51 6B D3 51 63 CA 23
3D0   87 83 48 44 B5 92 48 23 2A 8B 23 1A 06 8E 6A 25
3E0   AF 00 54 BF 3C 33 2C 36 06 A8 4B 33 A1 70 33 A1
3F0   05 5D 54 44 06 2F 45 03 54 44 29 06 61 57 00 00

SOURCE CHECKSUM   3817
```

PROGRAM

```
00001   .TITLE  MUS26N,  'THE ENTERTAINER'
00002   .LIST X'33
00003   .CHIP 421
00004   .IF  0>1
00005
00019   ;THIS IS A VERSATILE ELECTRONIC MUSICMAKER.  IT CONSISTS OF
00020   ;A COP421, SEVERAL Q'S,R'S,C'S,AND D'S PROVIDING SPEAKER
00021   ;DRIVE, WAVEFORM OR-GATE TO OR DO AND D1, WAVEFORM AMPLITUDE
00022   ;MODULATION FROM A 4 BIT DAC-INTEGRATOR OPERATED FROM L4-7,
00023   ;WITH FAST ATTACK FROM D2 AND CUTOFF FROM D3.  IT DRIVES AN 8
00024   ;OHM 2 1/2 INCH SPEAKER.  A SLIDING SWITCH ASSEMBLY SELECTS
00025   ;REST OR ONE OF 21 NOTES, AND WITH A MOMENTARY SET BUTTON
00026   ;SELECTS THE INSTRUMENT TYPE. A MOMENTARY CHANGES INSTRUMENT ON THE
00027   ;NEXT NOTE IN ORCHESTRA MODE. A MOMENTARY/LOCK SELECTS ALL NOTES
00028   ;(GLISSANDO) OR 'ONE NOTE AT A TIME'.  R'S AND C'S PROVIDE
00029   ;CLOCK AND MODULATION OF CLOCK VIA L1,L2,L3 FOR VIBRATO EFFECT.
00030   ;THERE IS INPUT POLARITY DIODE AND CAP, OUTPUT JACK FOR EXTERNAL
00031   ;SPEAKER,AMP,OR HEADPHONE.  POWER IS 5 AA CELLS.
00032   ;G3 TO GROUND CAUSES GLISSANDO'S.  G2 TO GROUND CHANGES INSTRUMENT
00033   ;ON NEXT NOTE (IN ORCHESTRA MODE ONLY).
00034
00035
00036   OLDPC    =        0
00037            ;OLDPC (OLD PRINTED CIRCUIT) DEFINES THE PC BOARD TYPE. =1
00038            ;FOR OLD BOARD WITH L7 LEFTMOST AND = 0 FOR NEW BOARD WITH
00039            ;L1 LEFTMOST.
00040   .FORM 'ASSIGNMENTS'
00041   ;  RAM    RAM    RAM    RAM    RAM    RAM    RAM    RAM
00042
00043   HTIMER   =        0,15              ;SPARAS
00044   SLDCNT   =        0,14              ;
00045   HSPKPT   =        0,13              ;SPARAS
00046   HNTPTR   =        0,12              ;
00047   SNGCNT   =        0,11              ;
00048   HLIN     =        0,10              ;
00049   MTNDL    =        0,9               ;RDNT
00050   HRDKBC   =        0,8               ;
00051   TEMPA    =        0,7               ;
00052   HELPTM   =        0,6               ;
00053   R005     =        0,5               ;
00054   R004     =        0,4               ;
00055   R003     =        0,3               ;
00056   R002     =        0,2               ;
00057   R001     =        0,1               ;
00058   SWDCFL   =        0,0               ;RDSW
00059
00060   SWLSLP   =        1,15              ;SPARAS
00061   BPITCH   =        1,14              ;SPARAS
00062   SPTBCN   =        1,13              ;SPARAS
00063   HLOUT    =        1,12              ;SPARAS
00064   HSNGPT   =        1,11              ;INIT
00065   HEVAL    =        1,10              ;
00066   HTNDL    =        1,9               ;
00067   R108     =        1,8               ;
00068   R107     =        1,7               ;
00069   LLELPT   =        1,6               ;
00070   R105     =        1,5               ;
00071   R104     =        1,4               ;
00072   R103     =        1,3               ;
00073   R102     =        1,2               ;
00074   R101     =        1,1               ;
00075   NTCNFL   =        1,0               ;RDSW
00076
00077   DCYSLP   =        2,15              ;INIT
00078   LPITCH   =        2,14              ;INIT
00079   RAMF     =        2,13              ;INIT
```

```
00080   LLOUT    =    2,12          ; INIT
00081   LSNGPT   =    2,11          ; INIT
00082   LEVAL    =    2,10
00083   DMASK    =    2,9           ; SPARAS
00084   R208     =    2,8           ;
00085   R207     =    2,7           ;
00086   R206     =    2,6           ;
00087   R205     =    2,5           ;
00088   R204     =    2,4           ;
00089   R203     =    2,3           ;
00090   SNGESC   =    2,2           ;
00091   ORCH     =    2,1           ;
00092   MELFLG   =    2,0           ; RDSW
00093   .FORM
00094
00095   LTIMER   =    3,15          ; SPARAS
00096   TMFLGS   =    3,14          ; SPARAS
00097   LSPKPT   =    3,13          ; SPARAS
00098   LNTPTR   =    3,12          ;
00099   ESCAPE   =    3,11          ;
00100   LLIN     =    3,10          ;
00101   LTNDL    =    3,9           ;
00102   LRDKBC   =    3,8           ;
00103   R307     =    3,7           ;
00104   LELPTM   =    3,6           ; SPARAS
00105   AMPLTD   =    3,5           ;
00106   SPCPR2   =    3,4           ;
00107   SPCPR1   =    3,3           ;
00108   SPC      =    3,2           ; DSET
00109   VOICE    =    3,1           ;
00110   VSWFLG   =    3,0           ; RDSW
00111
00112
00113   BIN      =    1
00114   SHIFT    =    0
00115   SOHI     =    8
00116   SOLO     =    0
00117   QLON     =    4
00118   QLOFF    =    0
00119   SLDIN    =    0
00120
00121   ; SWDCFL
00122   FDECAY   =    0
00123   FSWELL   =    1
00124   FDCTM    =    2
00125
00126   ; VSWFLG
00127   FVIBRATO=     0
00128   FSTACCATO=    1
00129   FWOW     =    2
00130   FSTACO   =    3
00131
00132   ; MELFLG
00133   FMELODY  =    0             ; 1=ONE NOTE   0=ALL NOTES
00134   FNTN     =    1
00135   FORCH2   =    2
00136   FORCH    =    3
00137
00138   ; NTCNFL
00139   FNTCN    =    0
00140   FSPCN    =    2
00141
00142   ; DMASK
00143   FATTACK  =    2
00144   FSOUND   =    3
00145
00146   BUZZFL   =    SPTBCN
00147   FBUZZ    =    3
```

```
00148
00149   GLISS    =        3                    ;G3 LOW = GLISSANDO
00150   NINSTR   =        2                    ;G2 LOW = NEW INSTRUMENT
00151
00152
00153   .IF      OLDPC=1
00154            VALA     =1
00155            VALB     =2
00156            VALC     =3
00157            VALD     =4
00158            VALE     =5
00159            VALF     =6
00160            VALG     =7
00161   .ELSE
00162            VALA     =7
00163            VALB     =6
00164            VALC     =5
00165            VALD     =4
00166            VALE     =3
00167            VALF     =2
00168            VALG     =1
00169   .ENDIF
00170
00171   .MACRO   VOICE
00172   .SET     X,1
00173   .SET     Y,3
00174   #1:
00175   .DO      #2
00176   .IF      X=#2
00177            .SET     X,0
00178            .ENDIF
00179   .WORD    #1 + X & 0000F * 16 + #Y
00180   .SET     X,X+1
00181   .SET     Y,Y+1
00182   .ENDDO
00183   .ENDM
00184   .FORM /CLRA,CLRM,DSNG,RDNT,RDN2,SPAR/
00185   .LOCAL
00186   .PAGE    0
00187   START
00188            CLRA
00189   CLRM:
00190   L1CLRM:  XABR                         ;USED BY CLEAR LOOP
00191   L2CLRM:  CLRA
00192            XIS                          ;LOAD 0'S UPWARD
00193            JP       L2CLRM              ;TILL TOP
00194            XABR                         ;SWAP BR/A
00195            AISC     13                  ;INCREMENT & TEST
00196            JP       L1CLRM
00197            LBI      LEVAL
00198            STII     8                   ;SET INIT SNG INSTR (PIANO)
00199            JMP      INIT
00200   ;DO SONG  - PLAY SONG UPON POWERUP
00201
00202   DSNG:
00203   ;CUT OFF OLD NOTE
00204            LBI      0,0
00205            OBD
00206   ;TEST SNGCNT  15=SKIP SONG
00207            LDD      SNGCNT
00208            AISC     1
00209            JSRP     SRRETSK
00210            JP       RDNT
00211   ;DO TABLE READ TO W
00212            LEI      BIN+SOHI+QLOFF      ;SETUP TABLE READ MODE
00213            LBI      HSNGPT
00214            LD       3                   ;FETCH POINTER
```

```
00215            JSR      M1DSNG            ;JUMP TO TABLE QUAD
00216   M2DSNG:                             ;RETURN FROM TABLE QUAD
00217   ;TKF Q TO LEVAL & SNGESC
00218            LBI      LEVAL
00219            CQMA                       ;LO NIB TO LEVAL (NOTE)
00220            LBI      SNGESC            ;B:SNGESC
00221            X                          ;HI NIB TO SNGESC, DURATION
00222   ;ADVANCE SONG POINTER
00223            LBI      LSNGPTR
00224            JSRP     ADINB
00225            JSRP     ADCNB
00226   ;DO FNRDL TO INIT OUTPUTS
00227            JSR      FNRDL
00228   ;TEST ESCAPE
00229            LDD      SNGESC
00230            AISC     15
00231            JMP      M1SNG             ;ESCAPE=0,DO CHANGE
00232   ;ESCAPE NOT =0
00233            JSRP     DLYMAX
00234            LBI      SLIDCNT
00235            JSRP     CLNB
00236            JP       RDN2
00237   .FORM    'RDNT,RDN2'
00238   ;READ NEW NOTE FROM KEYBOARD
00239
00240   RDNT:
00241
00242   ;RESET SLIDE COUNT
00243            LBI      SLIDCNT
00244            JSRP     CLNB
00245   ;READ KEYBOARD
00246            JSR      RDKB              ;READ KEYBOARD TO EVAL
00247                                       ;LOOP IF UNSUCCESSFUL
00248   ;SUCCESSFUL READ
00249   ;TEST FOR BETWEEN NOTES DELAY
00250            SKGBZ    GLISS
00251            JSRP     DLYMAX            ;DO BETWEEN NOTE DELAY
00252   ;ENTRY FOR SONG
00253   RDN2:
00254   ;CLEAR ELAPSED TIME REGISTER
00255            LBI      LELPTM
00256            JSRP     CLREG
00257   ;SET TIME FLAGS AND CLEAR TIMER
00258            LBI      TMFLGS
00259            STII     0                 ;B:LTIMER
00260            JSRP     CLREG             ;CLEAR LTIMER AND HTIMER
00261   ;TEST FOR ORCH MODE, THEN FOR NEW INSTRUMENT FLAG
00262            LBI      MELFLG
00263            SKMBZ    FORCH
00264            JSRP     SRRETSK
00265            JMP      M2RDN2
00266            SKMBZ    FNIN
00267            JMP      DNIN
00268   M2RDN2:
00269   ;SET PARAMETERS PER FLAGS AND VALUES IN RAM
00270
00271   SPAR:                               ;FROM RDSW
00272
00273   ;SET DMASK
00274            LBI      DMASK
00275            STII     8
00276            LBI      NTCNFL
00277            STII     0                 ;RESET FNTCN,FSPCN,CNT
00278   ;SET BPITCH FROM LPITCH,   SET SPTBCN
00279            LBI      SPTBCN            ;B:SPTBCN
00280            STII     5                 ;SET TO 5,
00281            LBI      SPTBCN            ;RETURN B TO SPTBCN
00282            LDD      LPITCH            ;LPITCH TO A
```

```
00283            AISC     10                    ;TEST FOR >5
00284            AISC     6                     ;NOT>5,CORRECT VALUE
00285            STII     0                     ;>5,SET SPTBCN TO 0
00286            LBI      BPITCH                ;B:BPITCH
00287            X                              ;CORRECTED LPITCH TO B
00288            LD                             ;AND TO A
00289            JSRP     ADANB                 ;2X CORRECTED LPITCH TO BPITCH
00290   SPA5:
00291   ;SETUP SPC EFFECTS
00292            JSRP     RSPC
00293            CLRA
00294            AISC     SPCTBL & 00F0/16
00295            LEI      BIN + SOHI + QLOFF
00296            JSR      RUSPTI
00297                                           ;JSR TO LQID AT TABLE
00298            LBI      ESCAPE
00299            CQMA
00300            LBI      BPITCH
00301            JSRP     ADANB
00302   SPA4:
00303   M4SPAR:
00304   ;SET DECAY FLAG
00305            LBI      SWDCFL
00306            JSRP     CLNB
00307            LDD      DCYSLP
00308            AISC     15
00309            JSRP     SRRETSK
00310            SMB      FDECAY
00311   ;SET HLOUT
00312   ;TEST SWELL
00313            LDD      SWLSLP
00314            AISC     15
00315            JP       M5SPAR                ;NO SWELL
00316   ;SWELL
00317            SMB      FSWELL
00318            LBI      HLOUT
00319            LDD      AMPLTD
00320            X
00321            JP       M6SPAR
00322   M5SPAR
00323   ;NO SWELL
00324            SKMBZ    FDECAY
00325            SMB      FDCTM                 ;SET DECAY TIME FLAG
00326            LBI      HLOUT
00327            STII     15                    ;FULL AMPL,FAST ATTACK
00328            LBI      UMASK
00329            STII     12
00330   M6SPAR
00331   SPA2:                                   ;FROM DESC
00332            LBI      NTCNFL
00333            SKMBZ    FNTCN
00334            JMP      SPA3
00335            LBI      LNTPTR
00336            LDD      BPITCH
00337            X
00338            JMP      MSPA2
00339   .FORM    <JSRP SUBS>
00340   .LOCAL
00341   .PAGE    2
00342
00343   ;JSRP SUBS    JSRP SUBS    JSRP SUBS    JSRP SUBS
00344
00345   ;JSRP COMPLEMENT NIBBLE
00346
00347   COMPNB:
00348            X
00349            COMP
00350            X
```

```
00351   DLY3:
00352           JP      DLY2
00353
00354
00355   SRRETSK:
00356           RETSK
00357
00358   ;JSRP SUBTRACT
00359
00360   SBANB:
00361           SC
00362           JP      SBBANB
00363   SBINB:
00364           RC
00365
00366
00367
00368   SBBNB:
00369           CLRA
00370   SBBANB:
00371           COMP
00372           JP      ADCANB
00373
00374
00375   ;JSRP ADD
00376
00377   ADANB:
00378           RC
00379           JP      ADCANB
00380   ADINB:
00381           SC
00382   ADCNB:
00383           CLRA
00384   ADCANB:
00385           ASC
00386           NOP
00387           X       3
00388   DLY1:
00389   SRRET:
00390           RET
00391
00392   ;JSRP CLEAR REGISTER/NIBBLE
00393   CLRCG:
00394           X
00395           CLRA
00396           X       3
00397   CLNB:
00398           X
00399           CLRA
00400           X
00401   DLY2:
00402           JP      DLY1
00403
00404   ;JSRP   VARIABLE DELAY
00405   DLYMAX:
00406           CLRA
00407   DLYVAR:
00408           JP      MIDLYV
00409
00410
00411   ;JSRP   DELAYS 1 THRU 14
00412
00413   JSD14:
00414           NOP
00415   JSD13:
00416           NOP
00417   JSD12:
00418           NOP
```

```
JSD11:
        NOP
JSD10:
        NOP
JSD9:
        NOP
JSD8:
        NOP
JSD7:
        NOP
JSD6:
        NOP
JSD5:
        NOP
JSD4:
        NOP
JSD3:
        NOP
JSD2:
        JMP     SPKOUT

;JSRP PREPARE TO READ L
PRRDL
        JP      MPRRDL
;JSRP READ L PORT
RDLP:
        JP      MRDLP

;JSRP EVALUATE BYTE
EVBY
        JP      MEVBY

;JSRP R----------
RLRDKB
        LBI     LRDKBC
RVOICE
        LBI     VOICE
RAMPLT
        LBI     AMPLTD
RSPC
        LBI     SPC
DELAY7
DLY7:
        JP      DELAY6
```

```
. FORM    /JSR PAGE/
. PAGE    3
. LOCAL
MPRRDL:
        LBI     RAMF            ;SET Q
        LD
        CAMQ                    ;  T FF
        JP      MIPRRD
MRDLP:
        LBI     LLIN
        INL
        X       3
        X

FNRDL:
        LBI     HLOUT
        LD      3
        CAMQ
MIPRRD:
```

```
00487            UGI      15
00488            SC
00489            XAS
00490            LEI      BIN + SOHI + QLON
00491            LBI      HLIN
00492   DELAY6:
00493            JP       DELAY5
00494   MEVBY:
00495            JSR      COMPNB
00496            CLRA
00497            SKMBZ    3
00498            AISC     VALA
00499            SKMBZ    2
00500            AISC     VALB
00501            SKMBZ    1
00502            AISC     VALC
00503            SKMBZ    0
00504            AISC     VALD
00505            LBI      LLIN
00506            JSR      COMPNB
00507            SKMBZ    3
00508            AISC     VALE
00509            SKMBZ    2
00510            AISC     VALF
00511            SKMBZ    1
00512            AISC     VALG
00513            AISC     15
00514            RETSK
00515            LBI      LEVAL
00516            XAD      TEMPA
00517            CLRA
00518   DELAY4:
00519            JP       DLY3
00520   ;JSR DLYVAR & DLYSOM CONTINUED
00521   MIDLYV:
00522            LBI      SLDCNT
00523            SKGBZ    0
00524            JSR      SRRETSK
00525            STII     1
00526            SKT
00527            JP       MIDLYV
00528            AISC     1
00529            JP       MIDLYV
00530   DELAY5:
00531            JP       DELAY4
00532
00533
00534
00535
00536   .FORM    'INSTBL,DSET,INIT,SINSTR'
00537   .PAGE    4
00538   .LOCAL
00539   INSTBL
00540            .ADDR    XYLOPHONE        ;0
00541            .ADDR    CELLO            ;1
00542            .ADDR    MANDOLIN         ;2
00543            .ADDR    VIOLIN           ;3
00544            .ADDR    BASS             ;4
00545            .ADDR    SPEC1            ;5
00546            .ADDR    SPEC2            ;6
00547            .ADDR    GUITAR           ;7
00548            .ADDR    PIANO            ;8
00549            .ADDR    ORGAN            ;9
00550            .ADDR    SPEC3            ;10
00551            .ADDR    HARPSICHORD      ;11
00552            .ADDR    CLARINET         ;12
00553            .ADDR    BANJO            ;13
00554            .ADDR    ORCH1            ;14
```

```
00555            . ADDR    ORCH2              ; 15
00556
00557   ; JSR READ KEYBOARD
00558   RDKB:
00559            JSRP      RLRDKB
00560            JSRP      CLREG
00561   L1RDKB:
00562            LBI       LEVAL
00563            JSRP      CLREG
00564            JSRP      PRRDL
00565            DGI       13
00566            JSRP      RDLP
00567            JSRP      EVBY
00568            JP        M1RDKB
00569            JSRP      PRRDL
00570            RC
00571            XAS
00572            JSRP      RDLP
00573            JSRP      EVBY
00574            JP        M2RDKB
00575            JSRP      PRRDL
00576            LET       BIN + SULO + QLON
00577            JSRP      RDLP
00578            JSRP      EVBY
00579            JP        M3RDKB
00580            JSRP      RLRDKB
00581            CLRA
00582            AISC      4
00583            JSRP      ADANB
00584            JSRP      ADCNB
00585            SKC
00586            JP        L1RDKB
00587   ; DO REST
00588            JP        MREST
00589   M1RDKB:
00590            AISC      1
00591   M2RDKB:
00592            AISC      1
00593   M3RDKB:
00594            X
00595            JSR       UPEVAL
00596            JSR       UPEVAL
00597   ; JSR UPEVAL
00598   UPEVAL
00599            LDD       TEMPA
00600            JSRP      ADANB
00601            JSRP      ADCNB
00602            RET
00603   MREST:
00604            LDD       SNGCNT
00605            AISC      1
00606            JSRP      JSD2
00607            LBI       DMASK
00608            STII      0
00609            LBI       ESCAPE
00610            STII      0
00611            JSRP      JSD2
00612
00613   DSET:
00614            LBI       SNGESC
00615            STII      0
00616            LBI       SNGCNT
00617            STII      15
00618   L1DSET
00619            JSRP      PRRDL
00620            JSRP      RDLP
00621            LBI       LLIN               ; TEST LO
00622            SKMBZ     0                  ; AND LOOP TILL
```

```
00623            JSRP    SRRETSK          ;   HI
00624            JP      LIDSET
00625            JSR     RDKB             ;READ KEYBOARD
00626            LBI     HEVAL
00627            CLRA
00628            SKE
00629            JMP     NSTART
00630            LBI     MELFLG
00631            RMB     FORCH
00632   INIT:
00633            LBI     HSNGPT
00634            STII    SNGTBL&00F0/16   ;INIT HI NIBBLE OF SNGTBL
00635   INIT2:
00636            LBI     LLOUT
00637            STII    15               ;INIT LLOUT 1111
00638            STII    15               ;INIT RAMP
00639            STII    9                ;INIT LPITCH
00640            STII    0                ;INIT DCYDLP
00641            SMB     0                ;INIT MELFLG
00642            LBI     SWLSLP
00643            STII    0                ;INIT SWLSLP
00644            LBI     VSWFLG
00645            STII    0                ;INIT VSWFLG
00646            STII    0                ;INIT VOICE
00647            STII    0                ;INIT SPC
00648            JSRP    RAMPLT
00649            STII    0                ;INIT AMPLTD
00650   SINSTR:
00651            LBI     LEVAL
00652            CLRA
00653            JID
00654
00655   VIOLIN:
00656   MICELL
00657            JSRP    RAMPLTD
00658            STII    8                ;AMPLITUDE
00659            LBI     SWLSLP
00660            STII    2                ;SWELL
00661            LBI     VSWFLG
00662            STII    1                ;VIBRATO
00663   XLINST:
00664            JMP     DSNG
00665
00666   MIBASS:
00667   CELLO
00668            JSRP    RVOICE
00669            STII    6                ;VOICE
00670            JP      MICELL
00671
00672   BASS:
00673            LBI     LPITCH
00674            STII    3
00675            JP      MIBASS
00676
00677   GUITAR:
00678            LBI     DCYSLP
00679            STII    2                ;DECAY
00680            JSRP    RVOICE
00681            STII    7                ;VOICE
00682            STII    5                ;SPC
00683            JP      XLINST
00684
00685   MANDOLIN:
00686            LBI     DCYSLP
00687            STII    8
00688            JSRP    RVOICE
00689            STII    1                ;VOICE
00690            STII    1                ;SPC
```

```
00691            STII    0                ;SPCPR1
00692            STII    7                ;SPCPR2
00693            JP      X2INST
00694
00695   BANJO:
00696            JSRP    RSPC
00697            STII    8                ;STACCATO
00698            JP      X2INST
00699
00700
00701
00702   CLARINET:
00703            LBI     SWLSLP
00704            STII    8
00705            JP      X2INST
00706
00707   HARPSICHORD:
00708            LBI     DCYSLP
00709            STII    8                ;DECAY
00710            JSRP    RSPC
00711            STII    4                ;SPC
00712            STII    13               ;SPCPR1
00713            STII    6                ;SPCPR2
00714            JP      X2INST
00715
00716   PIANO:
00717            LBI     DCYSLP
00718            STII    2                ;DECAY
00719            JSRP    RVOICE
00720            STII    2                ;VOICE
00721            JP      X2INST
00722
00723   ORGAN:
00724            LBI     SWLSLP
00725            STII    2                ;SWELL
00726            LBI     VSWFLG
00727            STII    5                ;WOW + VIB
00728            STII    3                ;VOICE
00729            JSRP    RAMPLT
00730            STII    3                ;AMPLITUDE
00731            JP      X2INST
00732
00733   SPEC1:
00734            LBI     DCYSLP
00735            STII    1                ;DECAY
00736            LBI     VSWFLG
00737            STII    5                ;VIB + WOW
00738            JP      X2INST
00739
00740   XYLOPHONE:
00741            LBI     DCYSLP
00742            STII    4                ;DECAY
00743            LBI     VSWFLG
00744            STII    4                ;WOW
00745            STII    7                ;VOICE
00746            STII    3                ;SPC
00747            STII    5                ;SPCPR1
00748            STII    12               ;SPCPR2
00749   X2INST   JMP     DSNG
00750
00751   SPEC2:
00752            JSRP    RSPC
00753            STII    6                ;SPC
00754            STII    1                ;SPCPR1
00755            JP      PIANO
00756
00757   SPEC3:
00758            JSRP    RSPC
```

```
00759            STII     7                    ;SPC
00760            STII     2                    ;SPCPR1
00761            JMP      VIOLIN
00762   ORCH2:
00763            JMP      MORCH2
00764   ORCH1:
00765            JMP      MORCH1
00766
00767
00768
00769
00770
00771   .FORM 'DESC::::SPEC EFFECTS'
00772   .PAGE    7
00773   .LOCAL
00774   SPCTB1:
00775            .WORD    000                  ;#0 NO ESCAPE...NO SPC
00776            .WORD    0F6                  ;#1 ESCAPE=F,BPITCH SPCPR1/SPCPR2
00777            .WORD    0D0                  ;#2 ESCAPE=F,BPITCH SPCPR1/SPCPR2
00778            .WORD    0F6                  ;#3 BPITCH SPCPR1/SPCPR2
00779            .WORD    0F0                  ;#4 ESCAPE=0,BPITCH SPCPR1/SPCPR2
00780            .WORD    0F1                  ;#5 ESCAPE=0,BPITCH=-1,TWANG
00781            .WORD    088                  ;#6 ESCAPE=F,CASCADE BY SPCPR1
00782            .WORD    048                  ;#7 ESCAPE=F,CASCADE BY SPCPR1
00783            .WORD    0F0                  ;#8 STACATTO
00784   ;MANDOLIN          =#1
00785   ;                  =#2
00786   ;XYLOPHONE         =#3
00787   ;HARPSICHORD       =#4
00788   ;GUITAR            =#5
00789   ;SPEC1             =#6
00790   ;SPEC2             =#7
00791   ;BANJO             =#8
00792
00793
00794   ;JSR READ SPC TABLE 1
00795   RDSPT1:
00796            LQID
00797            RET
00798
00799   DESC:
00800
00801   ;RESET HIGH TIMER TO 0
00802            LBI      HTIMER
00803            JSRP     CLNB
00804   ;SELECT PROPER SPECIAL VIA SPC
00805            LDD      SPC
00806            COMP
00807            AISC     5
00808            JP       SPC5
00809            AISC     14
00810            JP       SPC3
00811   SPC1:
00812   SPC2
00813            LBI      ESCAPE
00814            STII     15
00815   SPC3:
00816   SPC4
00817   MSPC1:
00818   MSPC2
00819            LBI      NTCNFL
00820            CLRA
00821            AISC     2
00822            XOR
00823            X
00824            SKMBZ    1
00825            JSRP     SRRETSK
00826            JP       M1SPC1
```

```
00827            LBI     BPITCH
00828            LDD     SPCPR1
00829            X
00830            JP      XISP
00831   M1SPC1:
00832            LBI     BPITCH
00833            LDD     SPCPR2
00834            X
00835   M2SPC1:
00836            LDD     SPC
00837            AISC    12
00838   XISP:
00839            JMP     SPA4
00840   XESCO:
00841            LBI     ESCAPE
00842            STII    0
00843            JP      XISP
00844   SPC5
00845            AISC    1
00846            JMP     SPC6
00847
00848            LBI     BPITCH
00849            JSRP    SBINB
00850            JP      XESCO
00851   M1SNG
00852            LBI     SNGCNT
00853            LD
00854            AISC    15
00855            JMP     M2SNG
00856            STII    15
00857            JMP     MREST
00858
00859
00860
00861
00862   .FORM  'NTTBL & STNDL'
00863   .PAGE   8
00864   .LOCAL
00865
00866   NTTBL:
00867
00868   .WORD 571-480
00869   .WORD 571-452,571-428,571-404,571-380
00870   .WORD 571-360,571-340,571-320,315-300
00871   .WORD 315-284,315-268,315-252,315-240
00872   .WORD 315-226,315-214,315-202,315-190
00873   .WORD 315-180,315-170,315-160,315-150
00874   .WORD 315-142,315-134,315-126,315-120
00875   .WORD 315-113,315-107,315-101,315-95
00876   .WORD 315-90,315-85,315-80,315-75
00877   .WORD 315-71,315-67,315-63,315-60
00878
00879   ;BASED ON 60 INSTRUCTION MIN COUNT, MULT 1.05946094
00880   ;480,452,428,404,380,360,340,320,300,284,268,252,
00881   ;240,226,214,202,190,180,170,160,150,142,134,126,
00882   ;120,113,107,101, 95, 90, 85, 80, 75, 71, 67, 63,
00883   ; 60
00884
00885
00886
00887   ;JSR     SET TONE DELAY
00888
00889   STNDL:
00890            LEI     BIN+SOHI+QLOFF
00891            LBI     HNTPTR
00892            LD      3
00893            LQID
00894            LBI     LTNDL
```

```
00895            CUMA
00896            X        3
00897            X        1
00898            STII     15
00899            LBI      HNTPTR              ;CORRECT 28 UP +256
00900            LD       3
00901            AISC     15
00902            JSRP     SRRETSK
00903            RET
00904            LD
00905            AISC     8
00906            JSRP     SRRETSK
00907            RET
00908            LBI      HTNDL
00909            STII     14
00910            RET
00911
00912
00913
00914   .FORM  'VOICES'
00915   .PAGE    9
00916   .LOCAL
00917
00918
00919   SNGTBL:
00920            ;SCALE
00921            .WORD    000,03A,05A,07A,08A,0AA,0CA,0EA,0FA,032,000
00922
00923   M2SNG:
00924            AISC     2
00925            NOP
00926            X
00927            JMP      DSNG
00928
00929
00930
00931
00932
00933   .FORM  'SPEAKEROUT'
00934   .PAGE    10
00935   .LOCAL
00936   VOICE0:
00937            VOICE    V0,2,0,3
00938   VOICE1
00939            VOICE    V1,2,0,1
00940   VOICE7:
00941            VOICE    V7,4,0,1,2,3
00942   VOICE4
00943            VOICE    V4,12,0,0,3,1,0,2,1,1,2,0,1,3
00944   VOICE3
00945            VOICE    V3,6,0,2,1,2,0,3
00946   VOICE6
00947            VOICE    V6,6,0,2,0,1,3,3
00948   VOICE2:
00949            VOICE    V2,4,0,2,1,3
00950   MIDSNG
00951            LQID
00952            RET
00953   MORCH2:
00954            LBI      MELFLG
00955            SMB      FORCH2
00956            JP       MIORC2
00957   MORCH1:
00958            LBI      MELFLG
00959            RMB      FORCH2
00960   MIORC2
```

```
00961            JMP      M2ORC2
00962
00963   .=02AD
00964
00965
00966   SPKOUT:
00967            LBI      SPTBCN
00968            RC
00969            LD
00970            ASC
00971            JP       M1SPKO              ;5;NO CARRY=TABLE READ
00972   ;CARRY   WRAP AND RESTORE
00973            AISC     1
00974            X
00975            JSR      DELAY7
00976            JMP      M2SPKO              ;18
00977   M1SPKO:
00978   ;NO CARRY    READ TABLE
00979            X        1                   ;RESTORE SPTBCN,B:HSPKPT
00980            LD       3                   ;HSPKPT-A; B:LSPKPT
00981            LEI      BIN+SOHI+QLOFF
00982            LQTD
00983                                         ;2 T'S
00984            CQMA                        ;HI ROM -LSPKPT
00985            LBI      DMASK
00986            XOR
00987            CAB                         ;DMASK XOR LO ROM - B
00988            OBD                         ;   AND TO D
00989   M2SPKO:
00990            LBI      HLOUT               ;H/L LOUT TO Q
00991            LD       3
00992            CAMQ
00993            LEI      BIN+SOHI+QLON       ;24
00994
00995
00996   ;TONE DELAY
00997
00998
00999   TNDL:
01000            LBI      LTNDL
01001            SKMBZ    0
01002            JP       M1TNDL
01003            NOP
01004   M1TNDL:
01005            LD       3
01006            AISC     2
01007            JP       .-1
01008            LD       1
01009   M3TNDL   AISC     1
01010            JP       M2TNDL
01011            LD
01012   M5TNDL:  AISC     1
01013            JP       M4TNDL
01014            JP       LIML
01015   M4TNDL   JSR      DLY251
01016            JP       M5TNDL
01017   M2TNDL:  JSR      DELA11
01018            JP       M3TNDL
01019
01020
01021   ;TIMER
01022
01023   TIMER:
01024            SKT
01025            JP       M1TIME
01026   ;UPDATE  LTIMER
01027            STII     0                   ;SET FLAGS  TO TASK
01028                                         ;B:LTIMER
```

```
01029            LD
01030            AISC     1
01031            XDS      3                    ;B:SLDCNT
01032   ;TEST FOR SLIDE MOTION
01033   M2TIME:
01034            SKGBZ    SLIDIN
01035            JP       M3TIME               ;SLIDIN HI
01036   ;SLIDIN LO
01037            STII     1
01038            JSRP     JSD9
01039   ;SLIDE UP
01040   M3TIME:
01041            LD                            ;B IS AT SLDCNT
01042            AISC     15
01043            JP       M4TIME               ;COUNT WAS 0,EXIT
01044            AISC     15                   ;B IS AT SLDCNT
01045            AISC     3                    ;COUNT WAS 1,SET TO 2
01046            X                             ;COUNT WAS 2 OR MORE
01047            X
01048   M5TIME:
01049            SKGBZ    GLISS
01050   X1TIME
01051            JMP      SPKOUT
01052   X2TIME:
01053            JMP      DSNG                 ;FROM THERE TO RDNT
01054   M1TIME:
01055            JSRP     SRRET
01056            LBI      SLDCNT
01057            JP       M2TIME
01058   M4TIME:
01059            JSRP     JSD7
01060
01061   ;MAINLOOP
01062
01063   ML:
01064   LIML:
01065   ;TEST TIME/TASK FLAG
01066            LBI      TMFLGS
01067            SKMBZ    0
01068            JP       TIMER                ;3;FLAG=1,DO TIME
01069   ;DO TASK
01070            STII     15                   ;SET FLAGS FOR TIME
01071   ;JUMP TO TASK                           ;B IS AT LTIMER
01072   JTT:
01073            CLRA
01074            JID                           ;7;
01075   .FORM 'TASK TABLE'
01076
01077   .PAGE 12
01078   .LOCAL
01079
01080   ;TASK JUMP TABLE
01081
01082   TSKJTB:
01083            .ADDR    SERT,SERT,ELPT,SWLL
01084            .ADDR    WWOW,TELP,VIBR,DDEC
01085            .ADDR    RDLS,TSLS,SLDC,TESC
01086            .ADDR    SNGE,SERT,SERT,SERT
01087
01088
01089   ;READ LO
01090
01091   RDLS:
01092            LBI      LLIN
01093            INL
01094            X
01095            JSRP     JSD11
01096
```

```
01097   .FORM 'TASKS'
01098   ;APPROX PAGE 13
01099   .LOCAL
01100
01101
01102   ;VIBRATO
01103
01104   VIBR:
01105           LBI     VSWFLG
01106           CLRA
01107           AISC    2
01108           SKMBZ   FVIBRATO
01109           AISC    8
01110           SKMBZ   FWOW
01111           AISC    4
01112           LBI     LLOUT
01113           XOR
01114           X
01115           JSRP    JSD5
01116
01117   ;DECAY (FADE)
01118
01119   DDEC:
01120           LBI     SWDCFL
01121           SKMBZ   FDCTM
01122           JP      MIDDEC
01123           JSRP    JSD12
01124
01125   MIDDEC:
01126           LBI     HTIMER
01127           SKMBZ   0
01128           JSRP    JSD10
01129           LBI     HLOUT
01130           LDD     DCYSLP
01131           SC
01132           CASC
01133           JP      M2DDEC
01134           X
01135           JSRP    JSD2
01136   M2DDEC:
01137           STII    0
01138           JSRP    JSD2
01139
01140   ELPT:
01141           LBI     LLELPT
01142           SC
01143           CLRA
01144           AISC    3
01145           ASC
01146           NOP
01147           X       2
01148           CLRA
01149           ASC
01150           X
01151           JSRP    JSD4
01152
01153
01154   .FORM 'TASKS'
01155   .PAGE   13
01156   .LOCAL
01157   ;SPEAKER TABLE POINTERS
01158
01159   SPPTPT:
01160   .WORD   VOICE0 & 00FF
01161   .WORD   VOICE1 & 00FF
01162   .WORD   VOICE2 & 00FF
01163   .WORD   VOICE3 & 00FF
01164   .WORD   VOICE4 & 00FF
```

```
.WORD    VOICE4 & 00FF
.WORD    VOICE6 & 00FF
.WORD    VOICE7 & 00FF


;TEST LO

TSLS:
         LBI      MELFLG
         SKGBZ    NINSTR
         SKMBZ    FNIN
         SMB      FNIN
         LBI      LLIN
         SKMBZ    0
         JSRP     JSD8
         JMP      DSET


;INCREMENT AND TEST SLIDE COUNT

SLDC:
         LBI      SLDCNT
         CLRA
         SKE
         JP       M1SLDC
         JSRP     JSD11
M1SLDC:
         CLRA
         AISC     5
         SC
         ASC
         JP       M2SLDC
         JMP      DSNG              ;FROM THERE TO RDNT
M2SLDC:
         X
         JSRP     JSD5


;SWELL

SWLL:
         LBI      SWLCFL
         SKMBZ    FSWELL
         SKMBZ    FDCTM
         JP       M1SWLL
         LBI      HLOUT
         LDD      SWLSLP
         RC
         ASC
         JP       M2SWLL
         STII     15
         LBI      SWLCFL
         RMB      FSWELL
X1SWLL:
         JSRP     JSD2
M2SWLL:
         X
         JSRP     JSD4
M1SWLL:
         SKMBZ    FDECAY
         JP       M3SWLL
         JSRP     JSD9
M3SWLL:
         SMB      FDCTM
         LBI      DMASK
         RMB      FATTACK
         JSRP     JSD6
.FORM
```

```
;APPROX PAGE 14
.LOCAL


;WOW

WWOW:
        CLRA
        LBI     VSWFLG
        SKMBZ   FWOW
        AISC    4
        LBI     HLOUT
        XOR
        X
        JSRP    JSD8


;TEST ESCAPE

TESC:
        LBI     HTIMER
        LDD     ESCAPE
        AISC    15
        JSRP    JSD11
        AISC    1
        SC
        ASC
        JSRP    JSD7
        JMP     DESC


TELP:
        LBI     LELPTM
        CLRA
        SC
        ASC
        JSRP    JSD10
        CLRA
        X       3
        CLRA
        ASC
        JP      M1TELP
NSTART
        LBI     0,0
        JMP     START
M1TELP:
        X
        JSRP    JSD3


SPC6:
SPC7:
        AISC    2
        JP      SPC8
        LBI     DMASK
        STII    12
        LBI     NTCNFL
        SMB     FNTCN
        LBI     ESCAPE
        STII    15
        LDD     SPCPR1
        JSRP    SBANB
        JSRP    SBBNB
        SKC
        JSRP    SRRETSK
```

```
01301            JP       VISPA4
01302
01303   SNDOFF:
01304            LBI      DMASK
01305            RMB      3
01306            LBI      ESCAPE
01307            STII     0
01308            JMP      SPA2
01309
01310   SPC8:
01311            CLRA
01312            AISC     12
01313            JSRP     DLYVAR
01314   VISPA4:  JMP      SPA4
01315
01316
01317   ;TEST SERVICE TIMER
01318
01319   SERT:
01320
01321            LBI      HTIMER
01322            LD
01323            AISC     1
01324            NOP
01325            X        3                    ;B:LTIMER
01326            STII     1                    ;RESET LTIMER
01327            JSRP     JSD9
01328
01329
01330   SNGE:
01331            LBI      SNGESC
01332            LD
01333            AISC     15
01334            AISC     1
01335            AISC     2
01336            JSRP     SRRETSK
01337            JMP      DSNG
01338            X
01339            JSRP     JSD4
01340
01341   ;JSR DELAY 251
01342
01343   DLY251:
01344            XAD      TEMPA
01345            CLRA
01346            AISC     1
01347   LID251:
01348            JSR      DELA12
01349            AISC     1
01350            JMP      LID251
01351            XAD      TEMPA
01352            JSRP     DLY3
01353            RET
01354
01355
01356   ;JSR DELAYS
01357   DELA12
01358            NOP
01359   DELA11
01360            JSRP     DLY7
01361            JSRP     DLY1
01362            RET
01363
01364   MSPA2:
01365            LDD      LEVAL
01366            JSRP     ADANB
01367            LDD      HEVAL
01368            X
```

```
01369            JSRP    ADCNB
01370
01371
01372   SPA3:    JSR     STNDL                   ;FROM DESC
01373   ;SET SPEAKER POINTERS
01374            JSRP    RVOICE
01375            CLRA
01376            AISC    SPPTPT&00F0/16
01377            LQID
01378            LBI     LSPKPT
01379            CQMA
01380            X       3
01381            X
01382            JSRP    JSD2
01383
01384   M2ORC2:
01385            SMB     3
01386            LBI     ORCH
01387            STII    0
01388   DNIN:
01389            LBI     ORCH
01390            LD
01391            AISC    13
01392            AISC    4
01393            NOP
01394            X
01395            LBI     MELFLG
01396            RMB     FNIN
01397            SKMBZ   FORCH2
01398            AISC    4                       ;ORCH2  START-ORCH1 START
01399            NOP                             ;ORCH1 START IF NOT 0
01400            LBI     LEVAL
01401            X
01402            JMP     INIT
01403   .END
01404
01405
01406
```

We claim:

1. An array switching mechanism for a musical instrument utilizing a microprocessor, a card containing printed indicia representing notes of a musical composition and a manually operated slide, the card having indicia arranged in a generally rectangular matrix of columns and rows, the sequence of notes to be played in a musical composition being determined by the location of the indicia in the column direction, the frequency of a note being determined by the location of the indicia in the row direction with the frequency progressively changing from the lowest frequency at one end of the rows to the highest frequency at the opposite end of the rows, the manually operated slide extending across the card to align with the columns of indicia and slidable across the card along the rows, first and second electrical contacts carried by the slide, a first path aligned with the card and extending parallel to the rows of indicia on the cards, said first path having a plurality of elongated discrete electrical contacts with each contact extending the width of three columns of indicia, each elongated discrete electrical contact of the first path being connected to a separate pin on the microprocessor, second, third and fourth paths located adjacent to and extending parallel to the first path with each of the second, third and fourth paths having electrical conductors with contacts smaller than those of the first path, each of the second, third and fourth paths having only one contact aligned with each elongated electrical contact of the first path, the contact of each of the second, third and fourth paths being aligned with a different column of the three note indicia aligned with the elongated contact of the first path, the contacts of the second, third and fourth paths being electrically connected to different pins of the microprocessor with all of the contacts of the same path being connected to the same pin on the microprocessor, and a fifth path extending parallel to the second, third and fourth paths and having electrical contacts aligned with the gaps between the contacts of the second, third and fourth paths with all of the contacts of the fifth path being connected to one pin of the microprocessor, the first electrical contact of the slide being movable along the first, second, third and fourth paths to electrically connect a contact of the first path and a contact of either the second, third or fourth paths at a particular position of the slide, the second electrical contact of the slide being movable along the fifth path to signal the microprocessor upon engagement with an electrical contact of the fifth path that the slide has been moved prior to disconnecting a contact of the first path and a contact of either the second, third or fourth paths.

* * * * *